US011316289B2

(12) United States Patent
Schrettlinger et al.

(10) Patent No.: US 11,316,289 B2
(45) Date of Patent: Apr. 26, 2022

(54) SUPPORT BARREL FOR AN ELECTRICAL LEAD

(71) Applicant: TE Connectivity Germany GmbH, Bensheim (DE)

(72) Inventors: Christian Schrettlinger, Bensheim (DE); Olivier De Cloet, Lorsch (DE); Samir Aboulkassem, Darmstadt (DE); Uwe Bluemmel, Hemsbach (DE); Marcel Starke, Gross-Gerau (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/833,577

(22) Filed: Mar. 28, 2020

(65) Prior Publication Data

US 2020/0227842 A1 Jul. 16, 2020

Related U.S. Application Data

(63) Continuation of application No. PCT/EP2018/076174, filed on Sep. 26, 2018.

(30) Foreign Application Priority Data

Sep. 29, 2017 (DE) ..... 10 2017 217 476.5

(51) Int. Cl.
*H01R 9/05* (2006.01)
*H01R 4/18* (2006.01)
*H01R 4/20* (2006.01)

(52) U.S. Cl.
CPC ..... *H01R 9/0518* (2013.01); *H01R 4/183* (2013.01); *H01R 4/20* (2013.01)

(58) Field of Classification Search
CPC ..... H01R 2103/00; H01R 9/0518; H01R 9/0521; H01R 24/40; H01R 24/50;
(Continued)

(56) References Cited

U.S. PATENT DOCUMENTS 6,107,572 A * 8/2000 Miyazaki ..... H01R 9/0518 174/75 C
8,052,466 B2 * 11/2011 Okamoto ..... H01R 9/0518 439/585

(Continued)

FOREIGN PATENT DOCUMENTS

CN 103918129 A 7/2014
CN 107017528 A 8/2017

(Continued)

OTHER PUBLICATIONS

PCT Notification, The International Search Report and the Written Opinion of the International Searching Authority, International Application No. PCT/EP2018/076174, dated Dec. 11, 2018, 13 pages.

(Continued)

*Primary Examiner* — Phuong Chi Thi Nguyen
(74) *Attorney, Agent, or Firm* — Barley Snyder

(57) ABSTRACT

A support barrel for an electrical lead includes a first barrel end and a second barrel end opposite to the first barrel end in a circumferential direction. The first barrel end engages the second barrel end and forms a positive engagement acting in the circumferential direction.

14 Claims, 4 Drawing Sheets

(58) Field of Classification Search
CPC ..... H01R 24/44; H01R 43/16; H01R 43/02; H01R 4/625
USPC ..... 439/578–585, 887
See application file for complete search history.

(56) References Cited

U.S. PATENT DOCUMENTS

| | | | | |
|---|---|---|---|---|
| 9,306,355 | B2 | 4/2016 | Hanazaki | |
| 10,468,786 | B2 | 11/2019 | De Cloet et al. | |
| 2001/0053633 | A1 | 12/2001 | Konda | |
| 2017/0201034 | A1* | 7/2017 | Hikosaka ..... | H01R 13/6473 |

FOREIGN PATENT DOCUMENTS

| | | | |
|---|---|---|---|
| CN | 107204537 | A | 9/2017 |
| JP | 2006302824 | A | 11/2006 |
| JP | 2008282556 | A | 11/2008 |

OTHER PUBLICATIONS

Abstract of JP 2006302824, dated Nov. 2, 2006, 1 page.
The First Office Action and English translation, dated Oct. 29, 2020, 16 pages.
Abstract of CN107017528, dated Aug. 4, 2017, 1 pages.

* cited by examiner

SUPPORT BARREL FOR AN ELECTRICAL LEAD

CROSS-REFERENCE TO RELATED APPLICATIONS

This application is a continuation of PCT International Application No. PCT/EP2018/076174, filed on Sep. 26, 2018, which claims priority under 35 U.S.C. § 119 to German Patent Application No. 102017217476.5, filed on Sep. 29, 2017.

FIELD OF THE INVENTION

The present invention relates to a support barrel and, more particularly, to a support barrel for an electrical lead.

BACKGROUND

Support barrels may be used to impart mechanical stability to an electrical lead, in particular in such regions of the lead that are to be provided with a contacting element. In the case of a coaxial cable, in particular, the use of a support barrel may be advantageous; in this case, a support barrel is normally applied to the exposed outer shield. The shield, which for example may consist of a braid of strands, can then be drawn over the barrel, or folded or put over the latter.

The lead can then be provided with a contacting element that is to be electrically connected to the shield. Such a contacting element may itself be in the form of a barrel, at least in some portions, and at least partially surround the support barrel and the shield bearing against the outside of the support barrel. If this contacting element is then, for example, crimped, pressed or otherwise fixedly connected to the lead, the support barrel imparts mechanical stability to the lead. As a result, the inner insulation and the inner conductor of the coaxial cable is protected against deformation. Moreover, the support barrel may define a region at which the shield is folded back, or everted. The support barrel may then fix in place the shield, or the strand, arranged inside the support barrel.

In the case of the known support barrels, it is disadvantageous that either they can only be applied to the lead with difficulty or they do not sufficiently completely surround the lead. Parts of the shield, or individual strands, upon being folded over or everted, emerge from the lead at the regions not covered by the support barrel, and consequently do not follow the desired course actually defined by the support barrel.

SUMMARY

A support barrel for an electrical lead includes a first barrel end and a second barrel end opposite to the first barrel end in a circumferential direction. The first barrel end engages the second barrel end and forms a positive engagement acting in the circumferential direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
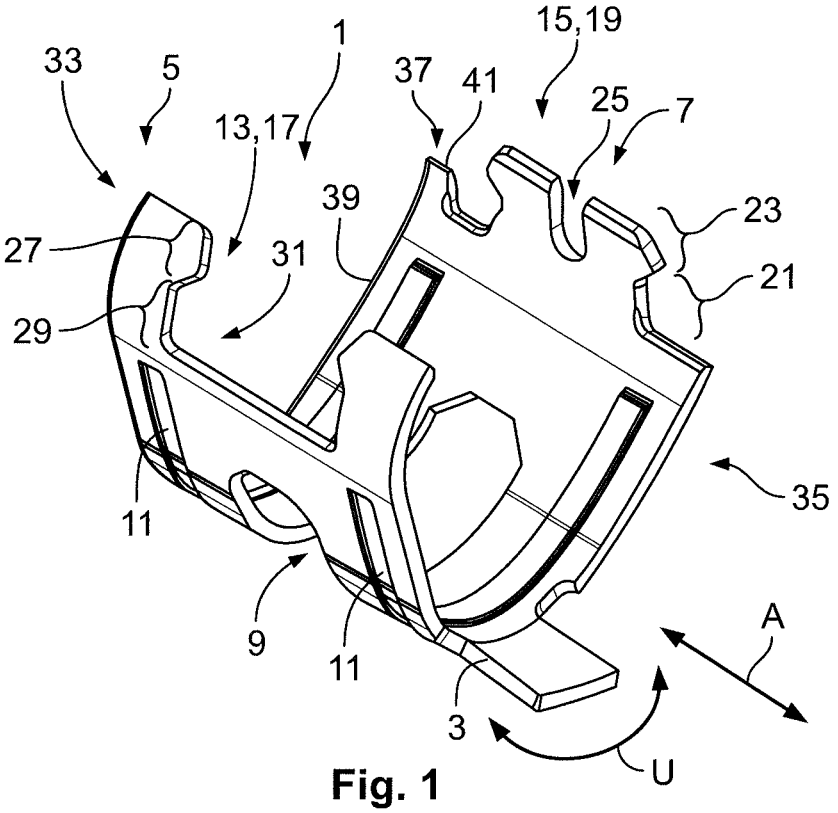
FIG. 1 is a front perspective view of a support barrel in an open state according to an embodiment.

The invention is explained by way of example in greater detail hereinafter using various exemplary embodiments, with reference to the drawings. The feature combinations exemplified in the embodiments may be complemented by further features, according to the properties of the support barrel according to the invention that are necessary for a particular application. Likewise, individual features in the case of the described embodiments may be omitted if the effect of this feature is not important in a specific application. In the drawings, the same reference numbers are used in each case for elements that have the same function and/or the same structure.

A support barrel 1 according to an embodiment is shown in FIGS. 1-6. The support barrel 1 is shown in an open state in FIGS. 1-4 and in a closed state in FIGS. 5 and 6. For reasons of simplicity, the stated directions that relate to the closed support barrel 1 are also used for the description of the support barrel 1 in the open state, and are accordingly indicated in FIGS. 1-4.

The support barrel 1, in an embodiment, is manufactured as a stamped bent part. In an embodiment, a material 3 of the support barrel 1 is steel, in particular high-grade steel. However, in other embodiments, the support barrel 1 may also be formed from a copper material, i.e. from a material containing copper. The support barrel 1 is formed such that it is laid around an electrical lead, and closed at the same time, by a single process step, in particular by crimping. This is possible, in particular, because of the shape of the support barrel 1 described hereinafter.

As shown in FIGS. 1-4, the support barrel 1 extends substantially along an axial direction A, along which an electrical lead is also arranged when the support barrel 1 is in use. The support barrel 1 further extends, transversely in relation to the axial direction A, along a circumferential direction U, from a first barrel end 5 to an opposite second barrel end 7. The barrel ends 5 and 7 are opposite each other in the circumferential direction U. The support barrel 1 extends continuously, at least in some portions, from the first barrel end 5 to the second barrel end 7.

Figure 2:
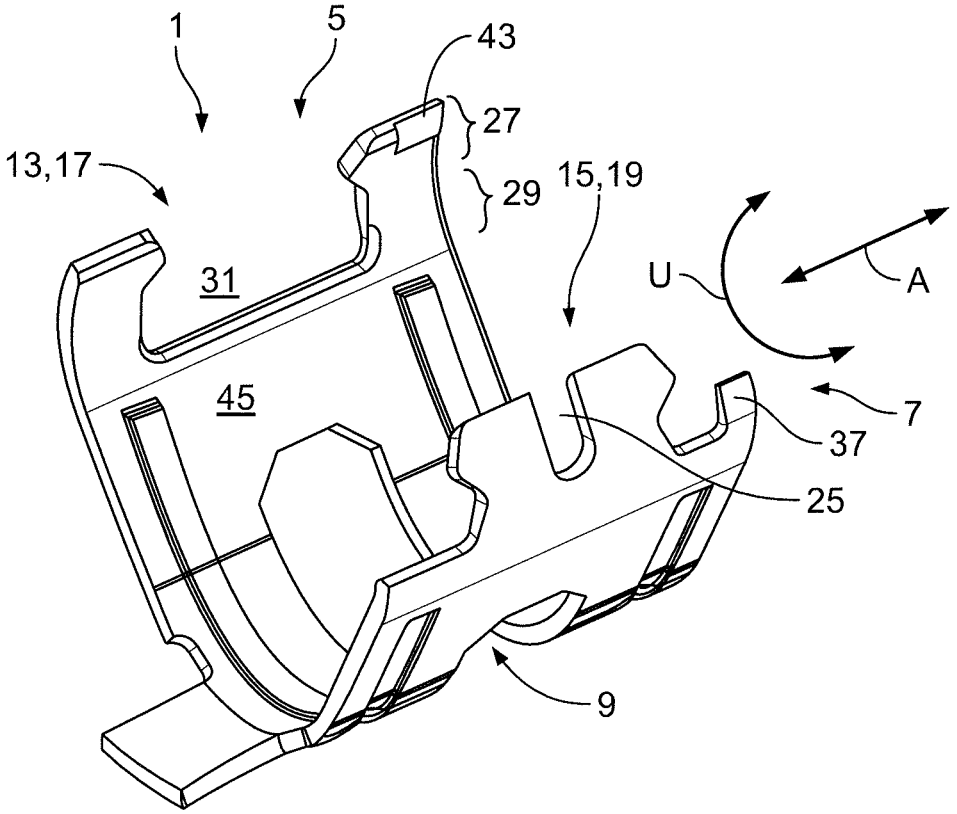
FIG. 2 is a rear perspective view of the support barrel in the open state.
Figure 3:
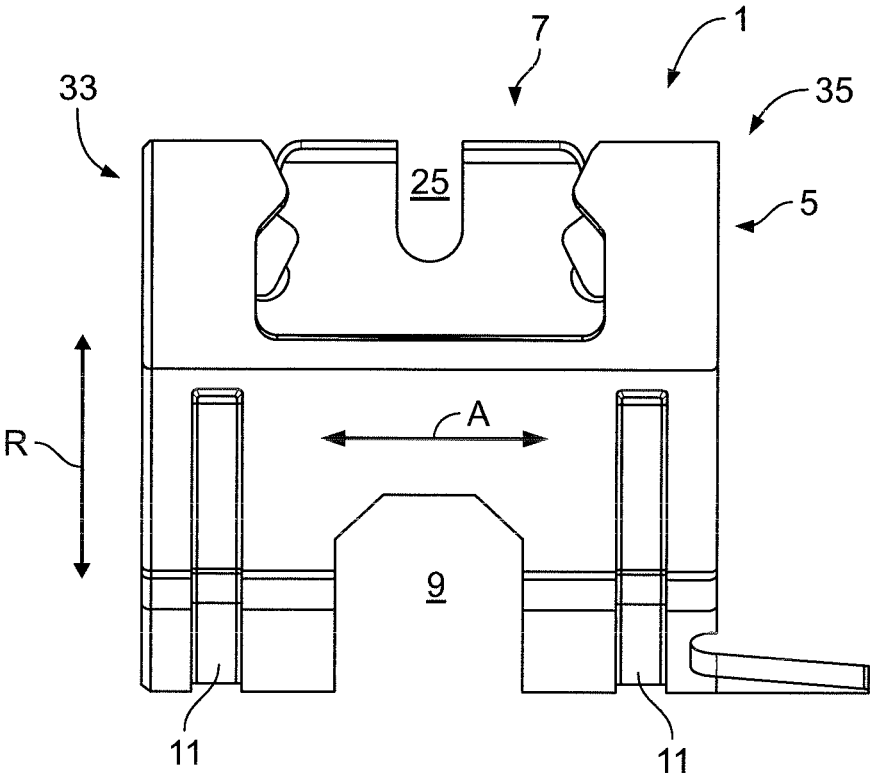
FIG. 3 is a side view of the support barrel in the open state.
Figure 4:
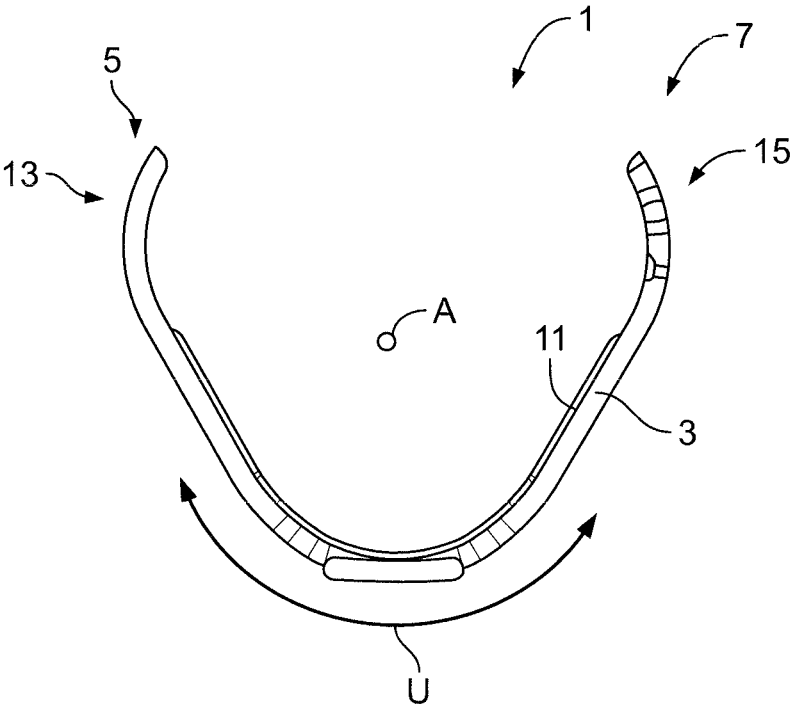
FIG. 4 is an end view of the support barrel in the open state.

The support barrel 1, in the embodiment shown in FIGS. 1-3, has an opening 9 in order to save material and to determine the deformability of the support barrel 1. The support barrel 1 may additionally be provided with a plurality of stiffening beads 11 that extend, parallel to the circumferential direction U, through the support barrel 1. The stiffening beards 11 can increase the stability of the support barrel 1. The opening 9 is arranged, in an embodiment, in the axial direction A between two stiffening beads 11.

The barrel ends 5 and 7 each have positive-engagement elements 13 and 15 that are configured to complement each other, as shown in FIGS. 1-4. In this case, the positive-engagement element 13 is formed as a closure-head receiver 17 on the first barrel end 5, and the positive-engagement element 15 is formed, on the opposite second barrel end 7, as a closure head 19 formed to be complementary to the closure-head receiver 17. The closure-head receiver 17 and the closure head 19 are shaped such that the closure head 19 can be received in the closure-head receiver 17 and is then held in positive engagement in the circumferential direction U. This is described in greater detail later with reference to FIGS. 5 and 6.

As shown in FIGS. 1 and 2, the closure head 19 has a neck portion 21 and a head portion 23. Along the axial direction A the head portion 23 is wider than the neck portion 21, and is spaced further apart than the neck portion 21 from the rest of the support barrel 1. At least the head portion 23 has a gap 25 that extends into the material of the support barrel 1, along the circumferential direction U. The gap 25 may also extend into the neck portion 21, or beyond it into the support barrel 1. The gap 25 opens the closure head 19 outwardly. Owing to the gap 25, the closure head 19 is elastically compressible in the axial direction A, at least in the head portion 23. As a result, insertion into the closure-head receiver 17 can be facilitated. Moreover, the gap 25, and the therewith associated elastic deformability of the closure head 19, can impart elasticity to the support barrel 1 in the closed state.

The closure-head receiver 17 is shaped to be complementary to the closure head 19. Accordingly, the closure-head receiver 17 has an entrance portion 27, shown in FIGS. 1 and 2, that opens the barrel end 5 outwardly in the circumferential direction U and that is formed to be complementary to the neck portion 21 of the closure head 19. Adjoining the entrance portion 27, along the circumferential direction U, is a receiving portion 29. Along the axial direction A the receiving portion 29 is wider than the entrance portion 27. The receiving portion 29 serves to receive the head portion 23 of the closure head 19. Owing to the fact that the receiving portion 29 is wider than the entrance portion 27 along the axial direction A, it constitutes an undercut recess 31. The recess 31 is undercut along the axial direction A.

Owing to the undercut recess 31, a positive engagement can be formed in an effective manner, in the circumferential direction U, between the closure head 19 and the closure-head receiver 17. The undercut recess 31 extends from the barrel end 5 into the support barrel 1, initially along the circumferential direction U, and then on at least one side transversely in relation to the circumferential direction U of the barrel 1, i.e. along the axial direction A.

The recess 31, as shown in FIGS. 1 and 2, is formed to be mirror-symmetrical with respect to the axial direction A. The same applies correspondingly to the closure head 19. In other words, the undercut recess 31 extends into the material of the support barrel 1, in the direction of the two mutually opposite axial ends 33 and 35 of the support barrel 1. Correspondingly, in the head portion 23, the closure head 19 protrudes over the neck portion 21, in the direction of the two axial ends 33 and 35.

The support barrel 1 has at least one axial locking member 37, as shown in FIGS. 1 and 2. The axial locking member 37 extends from the second barrel end 7 in the direction of the first barrel end 5. Alternatively, the axial locking member 37 may also be arranged at the first barrel end 5, and extend in the direction of the second barrel end 7. The axial locking member 37 is arranged at one of the axial ends 33 or 35 of the support barrel 1. In the shown embodiment, the axial locking member 37 is arranged, by way of example, at the axial end 33.

In the embodiment shown in FIGS. 1 and 2, the locking member 37 is flush with the support barrel 1 at the axial end 33. In other words, at a barrel end 33, an edge 39 of the support barrel 1 that runs along the circumferential direction U extends over the locking member 37. The edge 39 thus continues on the locking member 37. The locking member 37 is arranged next to the closure head 19 along the axial direction A, and in the circumferential direction U extends approximately as far as the head portion 23.

In a cross section along the axial direction A, the locking member 37 tapers to its end 41 that faces away from the rest of the support barrel 1. In other words, the axial locking member 37 becomes flatter towards its end 41, as shown in FIG. 1. Arranged on the first barrel end 5 is a recess 43, shown in FIG. 2, that serves to receive the axial locking member 37 when the support barrel 1 is in the closed state. The recess 43 extends on an inner side 45 of the support barrel 1 into the material thereof. The recess 43 is formed to be complementary to the locking member 37 in the shown embodiment.

The support barrel 1 shown in an open state in FIGS. 1-4 is described hereinafter in a closed state, with reference to FIGS. 5 and 6.

Figure 5:
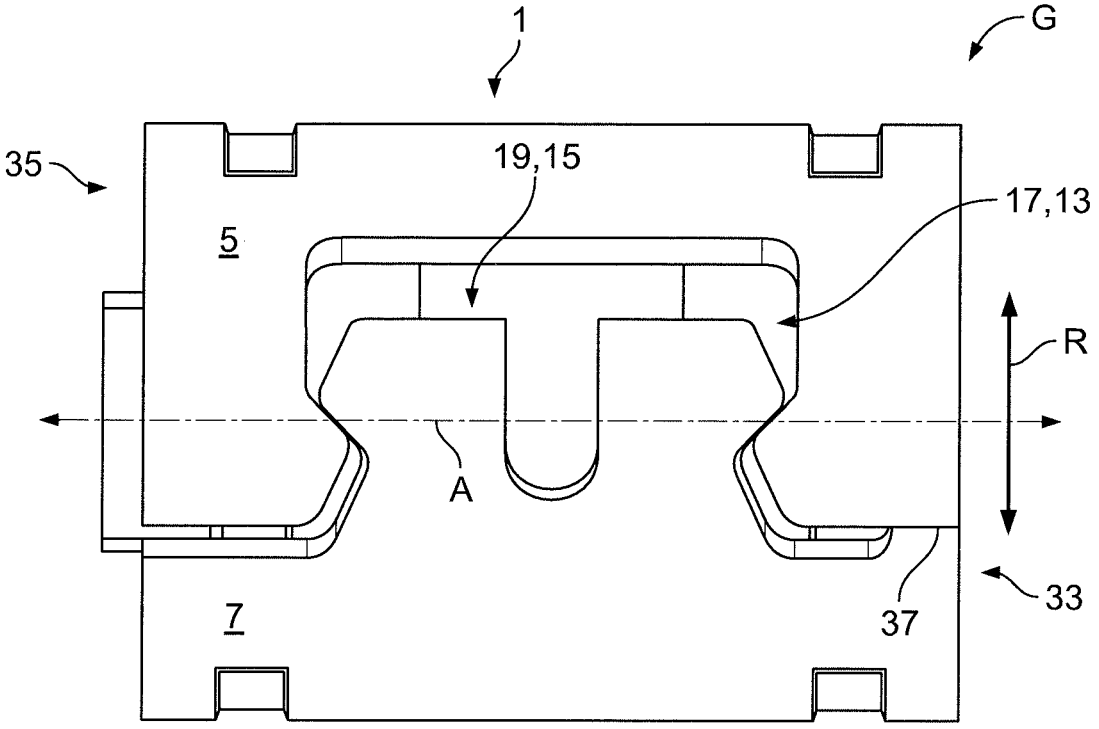
FIG. 5 is a top view of the support barrel in a closed state.
Figure 6:
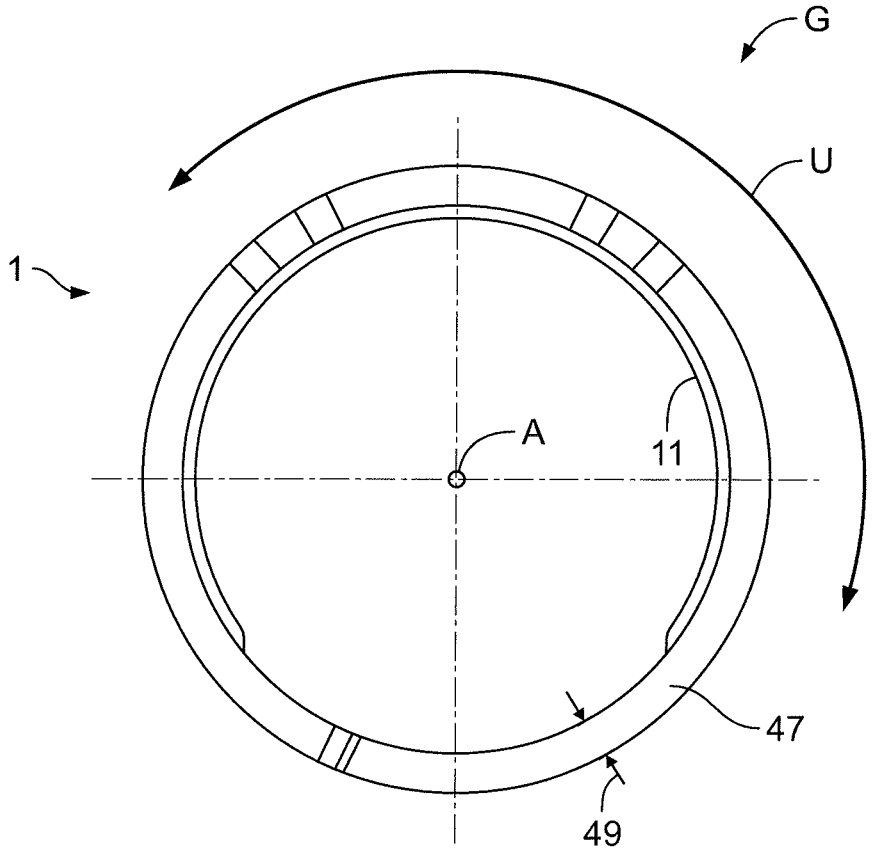
FIG. 6 is an end view of the support barrel in the closed state.

In the closed state G, as shown in FIGS. 5 and 6, the closure head 19 is arranged in the closure-head receiver 17. As a result, the barrel ends 5 and 7 engage in each other and form a positive engagement along the circumferential direction U. Owing to the fact that the closure head 19 projects into the closure-head receiver 17, the outer circumference of the support barrel 1 is continued along the circumferential direction U. In other words, the support barrel 1 does not have any gap that extends, along the axial direction A, through the entire support barrel 1.

In the closed state G, the support barrel 1 has a circular cross section as viewed along the axial direction A, as shown in FIG. 6. The support barrel 1 has an elongated shape that corresponds substantially to that of a hollow cylinder. The cylinder axis of the hollow cylinder in this case corresponds to the axial direction A. The circumferential direction U is accordingly arranged transversely thereto, and runs around the cylinder axis. In other embodiments, different cross-sectional shapes are possible. For example, the support barrel 1 may also have an elliptical or oval cross section. The positive-engagement elements 13 and 15, or the closure-head receiver 17 and the closure head 19, do not project out of the support barrel 1 or into it in a radial direction R. In other words, the positive-engagement elements 13 and 15 are located inside a hollow-cylinder wall 47 spanned by the rest of the support barrel 1.

As shown in FIG. 6, a thickness 49 of the hollow-cylinder wall 47 is determined by the material thickness of the material of the support barrel 1. The thickness 49 in cross section is optionally increased by stiffening beads 11, if applicable. Owing to the fact that, in the shown embodiment, no element of the support barrel 1 projects out of the hollow-cylinder wall 47, damage to an electrical lead, an insulation, or other elements can be prevented.

In the closed state G, the axial locking member 37 projects into the recess 43. The support barrel 1 is thereby closed all the way round, along the circumferential direction U, at the axial end 33. Consequently, strands are, in an effective manner, prevented from being drawn in at the end 33. Owing to the fact that the locking member 37 is arranged in the recess 43 of the first barrel end 5, the locking member 37 overlaps and bears against the first barrel end 5. The axial locking member 37 may be arranged, in the radial direction of the support barrel 1, on or under the material of the opposite barrel end 5. In an embodiment, the axial locking member 37 extends, in the radial direction, underneath the opposite barrel end 5.

Should the support barrel 1, in the closed state G, undergo deformation as a result of external action, the closure of the axial end 33 can continue to be ensured by way of the overlap of the locking member 37 with the opposite end 5. Even if the barrel ends 5 and 7 are drawn slightly apart, the axial end 33 remains closed, provided that the barrel ends 5 and 7 are not drawn further apart than the overlap of the locking member 37 with the first barrel end 5.

Because only the ends 5 and 7 engage in each other, it is possible to dispense with complicated production steps such as, for example, wrapping the lead, or the like. The positive engagement acting in the circumferential direction U can prevent the support barrel 1 from being bent apart. Owing to the mutual positive engagement, the barrel ends 5 and 7 are locked to each other, or the barrel 1 is closed at the barrel ends 5 and 7.

Figure 7:
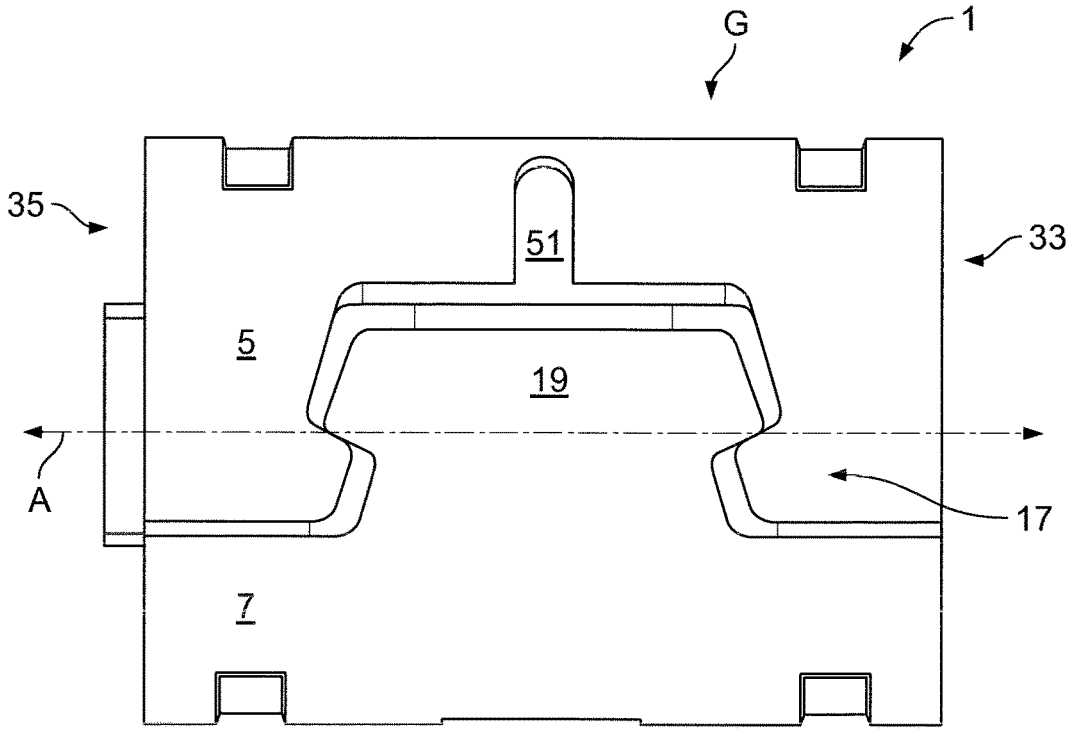
FIG. 7 is a top view of a support barrel according to another embodiment.

A support barrel 1 according to another embodiment is shown in FIG. 7. Only the differences in comparison with the embodiment described with reference to FIGS. 1-6 will be described in detail herein. The support barrel 1 in FIG. 7, like the support barrel 1 of the previously described embodiment in FIG. 5, is depicted in the closed state G.

The support barrel 1 of the embodiment of FIG. 7 differs from the support barrel 1 of FIGS. 1-6 in that there is no axial locking member 37. The dimensions of the closure-head receiver 17 and of the closure head 19 are matched to each other such that, in the closed state G, there is no gap between the two barrel ends 5 and 7. Small manufacturing tolerances may be permitted in this case, provided that any gap that exists between the barrel ends 5 and 7 is less than a diameter of the strands to be used. In an embodiment, however, the barrel ends 5 and 7 abut against each other in the region of the axial ends 33 and 35.

A further difference of the support barrel 1 of FIG. 7 in comparison with the support barrel 1 of FIGS. 1-6 is that it is not the closure head 19, but the opposite first barrel end 5, that is provided with a gap. In the embodiment shown in FIG. 7, a gap 51 extends from the closure-head receiver 17, along the circumferential direction U, into the support barrel 1. As a result, the closure head 19 is not elastically compressible, but the first barrel end 5 is elastically expandable.

An electrical connection element 53, which is provided with a support barrel 1 according to the invention, is described hereinafter with reference to FIG. 8. The electrical connection element 53 may be, in particular, a plug-in contact. The support barrel 1 may be formed according to one of the previously described embodiments. The support barrel 1 is closed around an electrical lead 55 by a single crimping process and, at the same time, the mutually opposite barrel ends 5 and 7 are brought into a positive engagement, such that the support barrel 1 is closed in an effective manner in the circumferential direction U.

Figure 8:
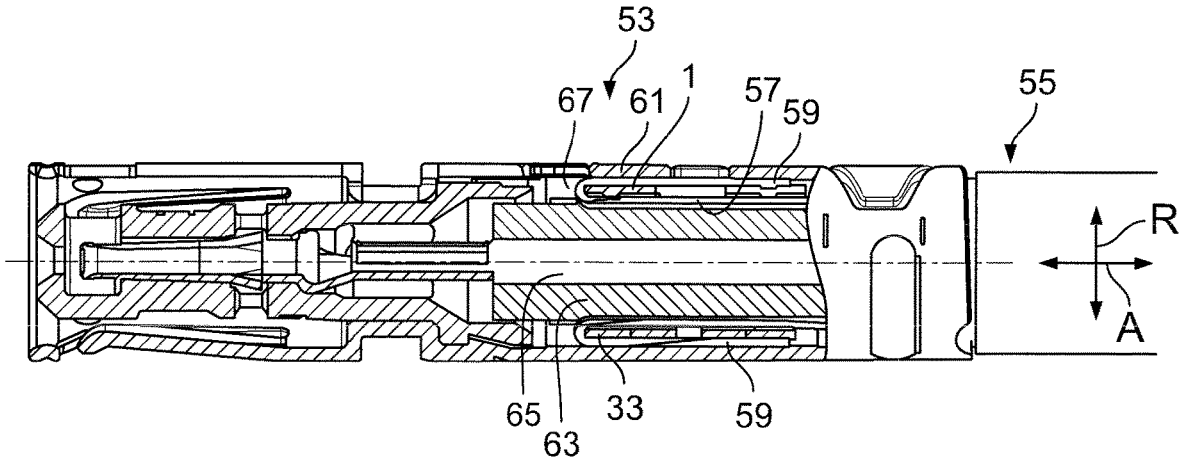
FIG. 8 is a sectional side view of an electrical connection element according to an embodiment having the support barrel.

The support barrel 1 is shown in FIG. 8 in the closed state, and bears against the electrical lead 55. In this case, the support barrel 1 is arranged surrounding a shield 57 of the electrical lead 55. The shield 57 may be formed, in particular, from a braid of strands. The electrical lead 55 is a coaxial cable in an embodiment.

To effect electrical contacting of the shield 57 of the electrical lead 55, the shield 57 is folded around the support barrel 1, or put over it, such that an end portion 59 of the shield 57 bears against the outside of the support barrel 1, as viewed in the radial direction R shown in FIG. 8. The end portion 59 is surrounded from the outside by a contacting element 61, and electrically contacted by it. The contacting element 61 is part of the connection element 53, and is connected to a part of the connection element 53 provided for contacting a counterpart. In particular, the contacting element 61 may be crimped. In other words, the contacting element 61 is pressed onto the end portion 59 of the shield 57.

The support barrel 1 ensures the mechanical stability of the electrical lead 55. In particular, the support barrel 1 prevents parts of the lead 55 that are arranged inside the support barrel 1, for example an insulation layer 63 or an inner conductor 63 shown in FIG. 8, from being damaged when the contacting element 61 is compressed or when the connection element 53 is used. Due to the barrel ends 5 and 7 engaging each other with positive engagement, the support barrel 1 is effective in preventing parts of the shield 57, in particular strands, from being drawn into the support barrel 1 upon being folded over or everted. Consequently, the support barrel 1 in this case is aligned such that, when it is provided with an axial locking member at the axial end 33, this axial end 33 faces towards a reversal region 67 of the shield 57. The support barrel 1 allows sufficient enclosure of the electrical lead 55, in particular of the shield 57, and that, at the same time, can be installed rapidly and easily on the lead 55, insofar as possible in an automated manner.

What is claimed is:

1. A support barrel for an electrical lead, comprising:

a first barrel end; and a second barrel end opposite to the first barrel end in a circumferential direction, the first barrel end engages the second barrel end and forms a positive engagement acting in the circumferential direction, the first barrel end has a closure-head receiver and the second barrel end has a closure head complementary to the closure-head receiver, the closure head is elastically deformable in an axial direction of the support barrel, the closure-head receiver has a recess formed by an entrance portion and a receiving portion adjacent the entrance portion in the circumferential direction, the receiving portion is positioned further from the first barrel end than the entrance portion and is wider than the entrance portion along the axial direction, the closure head has a neck portion and a head portion adjacent the neck portion in the circumferential direction, the head portion is wider than the neck portion along the axial direction.

2. The support barrel of claim 1, wherein the closure-head receiver and the closure head are arranged inside a hollow-cylinder wall spanned by the support barrel.

3. The support barrel of claim 1, wherein the closure head has a gap extending in the circumferential direction.

4. The support barrel of claim 1, wherein the first barrel end is crimped to the second barrel end.

5. The support barrel of claim 1, wherein the entrance portion is complementary to the neck portion and the receiving portion receives the head portion.

6. The support barrel of claim 1, wherein the closure head projects into the recess of the closure-head receiver.

7. The support barrel of claim 6, wherein the recess is undercut with respect to the circumferential direction.

8. The support barrel of claim 1, wherein the support barrel is formed of a steel or a copper material.

9. The support barrel of claim 8, wherein the support barrel is formed of a high-grade steel material.

10. The support barrel of claim 1, further comprising an axial locking member extending from the second barrel end in a direction of the first barrel end.

11. The support barrel of claim 10, wherein the axial locking member overlaps the first barrel end.

12. The support barrel of claim 10, wherein the axial locking member is flush with an axial barrel end.

13. An electrical connection element, comprising:

a support barrel including a first barrel end and a second barrel end opposite to the first barrel end in a circumferential direction, the first barrel end engages the second barrel end and forms a positive engagement acting in the circumferential direction, the first barrel end has a closure-head receiver and the second barrel end has a closure head complementary to the closure-head receiver, the closure head is elastically deformable in an axial direction of the support barrel, the closure-head receiver has a recess formed by an entrance portion and a receiving portion adjacent the entrance portion in the circumferential direction, the receiving portion is positioned further from the first barrel end than the entrance portion and is wider than the entrance portion along the axial direction, the closure head has a neck portion and a head portion adjacent the neck portion in the circumferential direction, the head portion is wider than the neck portion along the axial direction; and a contacting element surrounding the support barrel.

14. A support barrel for an electrical lead, comprising:

a first barrel end; and a second barrel end opposite to the first barrel end in a circumferential direction, the first barrel end engages the second barrel end and forms a positive engagement acting in the circumferential direction, the first barrel end has a closure-head receiver and the second barrel end has a closure head complementary to the closure-head receiver, the closure head is elastically deformable in an axial direction of the support barrel, the closure head has a gap extending in the circumferential direction.

* * * * *